United States Patent [19]

Hochstein

[11] 4,114,325

[45] Sep. 19, 1978

[54] INFLATABLE STRUCTURE

[76] Inventor: Alfred Hochstein, Viersener Strasse 50, Krefeld 1, Fed. Rep. of Germany, 4150

[21] Appl. No.: 817,732

[22] Filed: Jul. 21, 1977

[30] Foreign Application Priority Data

Jul. 22, 1976 [DE] Fed. Rep. of Germany ... 7623114[U]

[51] Int. Cl.[2] ..... E04B 1/34

[52] U.S. Cl. ..... 52/2

[58] Field of Search ..... 52/2; 5/365, 367; 46/87

[56] References Cited

U.S. PATENT DOCUMENTS

| | | | |
|---|---|---|---|
| 2,875,771 | 3/1959 | Brewin | 52/2 |
| 4,040,210 | 8/1977 | Land | 52/2 |

*Primary Examiner*—Price C. Faw, Jr.
*Assistant Examiner*—Carl D. Friedman
*Attorney, Agent, or Firm*—Herbert E. Kidder

[57] ABSTRACT

An inflatable structure particularly useful for providing emergency accommodation. The structure is comprised of an inflatable framework with inflatable cushions disposed in gaps of the framework.

8 Claims, 2 Drawing Figures

INFLATABLE STRUCTURE

BACKGROUND OF THE INVENTION

The invention relates to an inflatable structure.

Such structures are of special interest for providing, for example, emergency accommodation and sport halls. Known structures are known in the form of air-supported inflatable halls, wherein a pressure exceeding that of the ambient air is generated inside the hall. It is, therefore, necessary to provide special airlocks at the entrances and exits.

SUMMARY OF THE INVENTION

An object of the invention is to provide an inflatable structure which is simple to transport and inflate and in particular requires no complicated airlocks.

This object is achieved by forming the structure as an inflatable framework consisting of tubes with inflatable cushions interposed between the tubes. Assembly at the site of destination is effected by introducing a gaseous filling medium into the inflatable parts and then anchoring the structure. One advantage consists in that, unlike tents, only a relative small weight needs be transported to the place of erection and despite that a high degree of protection against the effects of the weather is ensured, as all gases are known to be excellent heat insulators.

This ready transportability means that the present invention is particularly attractive for providing emergency accommodation where speed is the primary consideration. Moreover, erection involves far fewer problems than pitching a tent, as the know-how required to set up a tent insofar as avoiding overstressing the tent panels, is unnecessary. The gas filling automatically ensures a homogeneous surface. The surface itself can be shaped wholly as desired, as there are no conditions that need be satisfied in this connection. For spaces that have to be totally closed in, such as swimming baths or camp halls, preference will be given to such constructions according to the invention that are substantially cup-shaped. On the other hand, it is often desirable to provide constructions that primarily provide localised protection against the elements such as in a sports stadium and thus nearly flat or only slightly curved surface forms are required.

An embodiment of the invention envisages interconnecting the inner chambers of the framework and the intervening cushions. This presents the advantage that the whole structure, consisting of the framework and cushions, can be inflated simultaneously, which is always advisable wherever assembly is to be rapid and problem free.

This interconnection may be obtained by welding the cushions to the tubes along their contact surfaces. It is also possible detachably to secure the cushions to the tubes of the framework, so making it easy to exchange defective cushions or to use variously formed cushions in the same framework. Furthermore, magnetic holding strips mounted on the contact surfaces of the cushions and tubes of the framework, may be provided for detachable mounting.

In a further development of the invention, it is envisaged to interconnect the tubes forming the framework so that they form square unit cells. Thus, the cushions to be fitted into the cells must also have the same square base surface. In this way, the cushions are arbitrarily interchangeable and can be assembled with their sides reversed. This applies likewise to frameworks having cushions which are equilateral triangles.

In another form of embodiment of the invention it is provided that both the framework and the cushions are filled with a gas of a density below that of ambient air. In this way the structure is buoyed up by the surrounding air, which greatly reduces the loads that the foundations have to support.

More particularly hot air may be used as the filling gas, which can allow to control to some extent, depending on the form of the structure, the temperature of the interior. This filling medium necessitates, however, the keeping of its own temperature constant by an additional heating mechanism.

No such heating is involved when helium is used as the filling gas, but this does not allow control over the temperature of the interior.

To prevent the collapse of the building as a result of possible damage to the tubular walls, and in some circumstances to the cushions, it is envisaged to introduce non-return valves, which restrict the area of a localised drop in pressure, at certain positions in the framework, and at the nodal points thereof in particular. It will be understood that the non-return valves must be provided in such numbers that such locally restricted drop in pressure would be confined to so small an area as not seriously to impair the stability of the structure as a whole.

In one embodiment of the invention the PVC-coated polyester fabric which fully satisfies the requirements of elasticity, strength and specific gravity, may be used as the material for the tubes of the framework and the cushions.

BRIEF DESCRIPTION OF THE INVENTION

The invention will now be described by way of example with reference to the accompanying drawings wherein:

FIG. 1 shows in perspective a unit cells of the framework of an inflatable structure, FIG. 2 a sectional view along the line II—II of FIG. 1.

DETAILED DESCRIPTION OF PREFERRED EMBODIMENTS OF THE INVENTION

Figure 1:
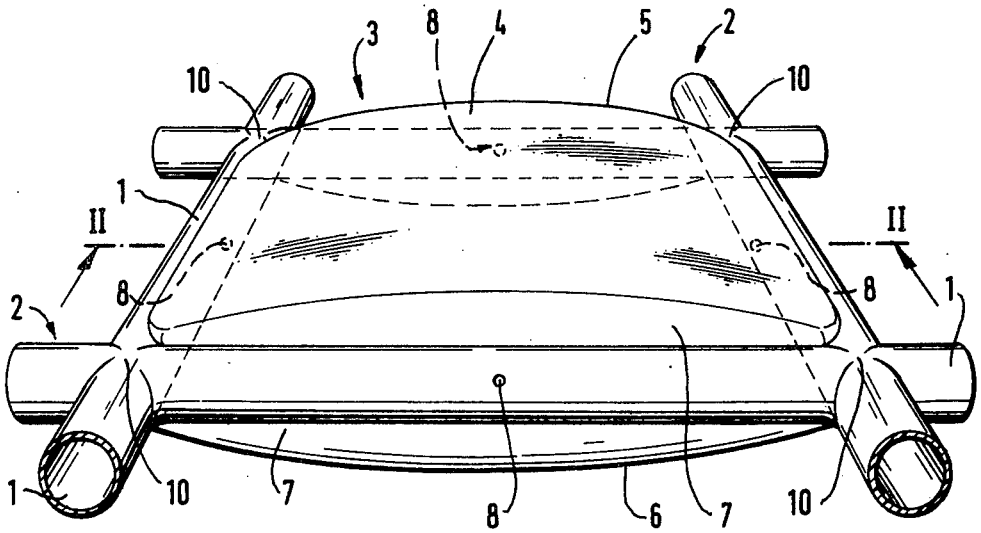

The inflatable structure shown in FIG. 1 according to an embodiment of the invention is made up of unit cells 3. Each unit cells 3 is formed of framework 2 built from tubes 1. In each unit cell 3 is arranged a cushion 4, which is likewise inflatable. Each of these cushions 4 is outwardly curved on its top side wall 5 and bottom side wall 6 and inwardly curved on the side walls 7. A high degree of stability can be obtained by making the side walls 7 concave inwardly in such a way that the surrounding tubes 1 are embedded by up to one half in the cushion 4. The interior of the cushion 4 communicates with the interior of the tubes 1 by connecting apertures 8. The cushion 4 may be either solidly welded to the tubes 1 or else detachably secured thereto. The tubes 1 intersect at nodal points 10. These are the points where non-return valves, serving as a prevention against possible damage to the outer skin of the tube 1 or else of the cushion 4, may preferably be emplace.

Figure 2:
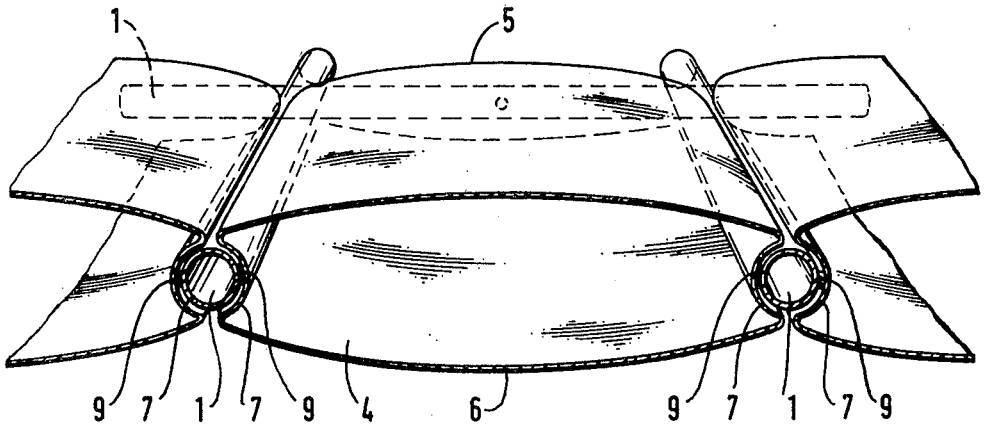

As may be seen from FIG. 2, the cushion 4 bears against or grips around the tubes 1 of the framework 2. In between the surface of contact of the cushion 4 and the tubes 1 are provided either releasable attachment members, such as magnetic retaining strips, or a welded joint 9. Here too the connections 8 between the cushion 4 and the tube 1 are formed in both cases. In order better to illustrate how the cushion 4 grips around the tube 1, two adjacent outside cushions 4 to the unit cell 3, have been shown.

I claim:

1. An inflatable structure having a plurality of inflatable interconnected unit cells, each unit cell comprising:

at least three hollow inflatable framework tubes lying in the same plane, said hollow inflatable framework tubes integrally connected to each other such that two of said hollow inflatable framework tubes interconnect at each of the corners of said unit cell forming a continuous pathway within the framework tube of each unit cell and each framework tube serving as a framework tube between two adjacent unit cells, a hollow inflatable cushion fitting within the area defined by the framework tube of each unit cell, said inflatable cushion abutting against said framework tube, and partially wrapping around the framework tube such that that portion of said inflatable cushion which abuts against said framework tube forms a concave surface which mates against a portion of said framework tube.

2. A structure according to claim 1, wherein the hollow inflatable framework and the hollow inflatable cushions are made from polyester fabric coated with PVC.

3. An inflatable structure having a plurality of inflatable interconnected unit cells of claim 1 wherein:

each unit cell comprises four hollow inflatable tubes interconnected to form a square shaped unit cell.

4. An inflatable structure having a plurality of inflatable interconnected unit cells of claim 1 wherein:

each unit cell comprises three hollow inflatable tubes interconnected to form a triangle shaped unit cell.

5. An inflatable structure having a plurality of inflatable interconnected unit cells of claim 1 including:

the interior of said hollow inflatable cushions connected to the interior of said hollow inflatable framework tubes by connecting aperature means.

6. An inflatable structure having a plurality of inflatable interconnected unit cells of claim 1 including:

attaching means, said attaching means attaching said portions of said hollow inflatable cushion which abuts against said hollow framework tube to said hollow framework tube.

7. An inflatable structure having a plurality of inflatable interconnected unit cells of claim 6 wherein:

said attaching means comprises welding said cushion to said tubes.

8. An inflatable structure having a plurality of inflatable interconnected unit cells of claim 6 wherein:

said attaching means comprises magnetized strips.

* * * * *